United States Patent [19]

Kommrusch

[11] 4,101,901

[45] Jul. 18, 1978

[54] INTERLEAVED ANTENNA ARRAY FOR USE IN A MULTIPLE INPUT ANTENNA SYSTEM

[75] Inventor: Richard Stephen Kommrusch, Hoffman Estates, Ill.

[73] Assignee: Motorola, Inc., Schaumburg, Ill.

[21] Appl. No.: 642,829

[22] Filed: Dec. 22, 1975

[51] Int. Cl.[2] ..... H01Q 21/06

[52] U.S. Cl. ..... 343/853; 343/844

[58] Field of Search ..... 343/853, 854, 895; 343/779, 844

[56] References Cited

U.S. PATENT DOCUMENTS

| | | | |
|---|---|---|---|
| 3,056,961 | 10/1962 | Mitchell | 343/854 |
| 3,193,830 | 7/1965 | Provencher | 343/729 |
| 3,295,134 | 12/1966 | Lowe | 343/854 |
| 3,375,524 | 3/1968 | Kunemund et al. | 343/799 |
| 3,560,985 | 2/1971 | Lyon | 343/854 |
| 3,623,111 | 11/1971 | Provencher et al. | 343/727 |

*Primary Examiner*—Eli Lieberman

*Attorney, Agent, or Firm*—James W. Gillman; Phillip H. Melamed

[57] ABSTRACT

An interleaved antenna array is disclosed in conjunction with an improved multiple transmitter antenna system for simultaneously generating two independent groups of composite radiation patterns for two separate pluralities of independent radio devices. A first plurality of isolated independent radio transmitters is coupled, without any signal cancellation, to each and every one of a first plurality of independent antenna elements which form a first group of composite radiation patterns for these transmitters. A second plurality of transmitters is likewise coupled to a second plurality of antenna elements which create a second group of composite patterns for these transmitters. The antenna elements of the first and second pluralities are alternately circumferentially disposed about a central axis and each produces a 90° half power beam width radiation pattern which is directed radially away from the central axis. First and second combining networks produce 90° electrical phase shifts between the adjacent radiation patterns produced by the elements in each of the two pluralities, respectively. By providing such an interleaved antenna array for first and second pluralities of independent transmitters, a single multiple input antenna system is provided which has a small size and produces a uniform omnidirectional pattern for each of the transmitters while maintaining isolation between each transmitter.

11 Claims, 9 Drawing Figures

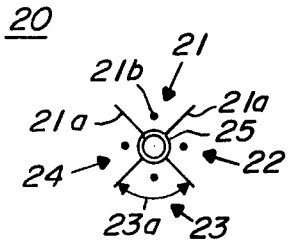
PRIOR ART
Fig. 1
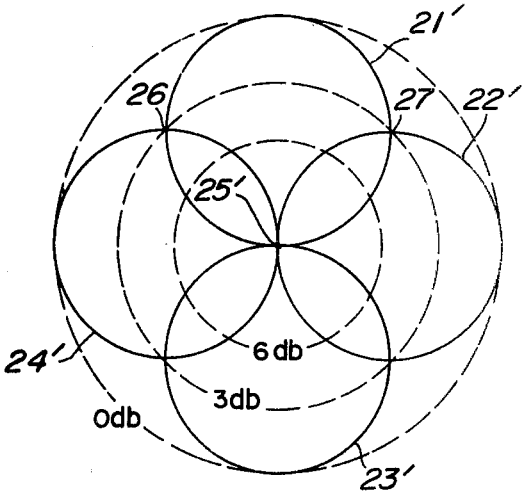
PRIOR ART
Fig. 2
Fig. 3
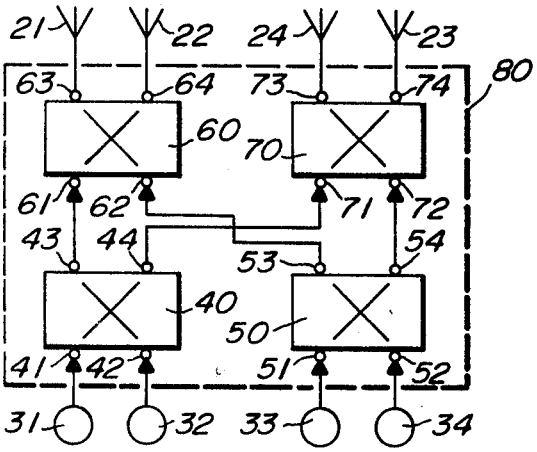
30 PRIOR ART
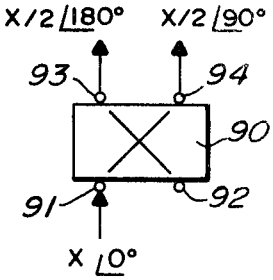
Fig. 4
PRIOR ART
Fig. 6
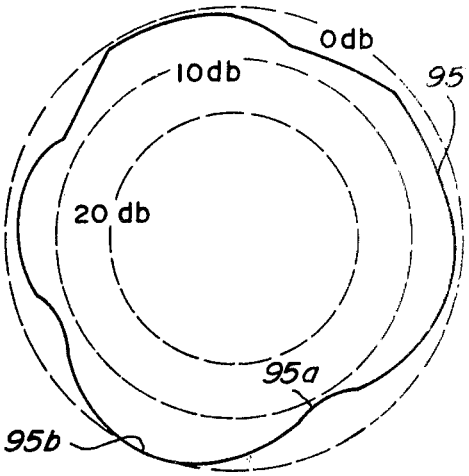
PRIOR ART
ANTENNAS
| TRANSMITTERS | 21 | 22 | 23 | 24 |
|---|---|---|---|---|
| 31 → | → | ↓ | ← | ↓ |
| 32 → | ↓ | ← | ↓ | → |
| 33 → | ↓ | → | ↓ | ← |
| 34 → | ← | ↓ | → | ↓ |
PRIOR ART
Fig. 5

INTERLEAVED ANTENNA ARRAY FOR USE IN A MULTIPLE INPUT ANTENNA SYSTEM

CROSS REFERENCE TO RELATED APPLICATION

The present invention is related to the invention described in the co-pending U.S. Patent Application of Allen Davidson entitled "Improved Multiple Input Antenna System," Ser. No. 601,560, filed Aug. 4, 1975, now abandoned, and assigned to the same assignee as the present invention.

BACKGROUND OF THE INVENTION

The invention relates generally to the field of multiple input antenna systems and more particularly to the simultaneous use of a single antenna array by pluralities of independent and isolated radio devices.

There have been a number of different solutions to the basic problem of simultaneously using a single antenna structure in conjunction with a number of independent transmitters while maintaining isolation therebetween.

One prior solution uses a single omnidirectional antenna and couples each of the transmitters to this antenna through an associated resonant cavity. Thus an omnidirectional radiation pattern is obtained for each transmitter and the output of each transmitter will not affect the output of any other transmitter. The primary disadvantage of this system is that it requires a separate tuned resonant cavity for each transmitter. Since every transmitter must operate at a substantially different frequency in order for the resonant cavities to provide the required isolation, close channel spacing in such a system is impractical. Also, because of the requirement for a tuned resonant cavity, such a system has an inherently narrow bandwidth. In addition, the resonant cavity must be adjusted whenever the operating center frequency of a transmitter is changed.

Another solution to the problem uses an array of hybrid networks to produce a single output signal which is then used to excite a single omnidirectional antenna element. Each of these hybrid networks combines two input signals to produce a half power output signal at one port while dissipating the rest of the power in a 50 ohm "dummy" load. In a typical eight transmitter network built according to this prior technique, a 9db loss in power is encountered. The use of hybrid networks does, however, provide isolation between the independent transmitters as well as permitting a wide bandwidth of operation for the antenna system.

Still another solution to the problem is to couple individual omnidirectional antenna elements to each of the transmitters. This solution is not practical because of the large separation that would have to exist between each of the radiating elements in order to provide sufficient isolation between each of the transmitters. Therefore the resultant antenna system would require an extremely large amount of space, especially if a large number of independent transmitters were desired.

In still another solution to the problem, two transmitters are combined by a single hybrid network and the two output signals from this network are then used to excite the two independent antenna elements in a turnstile antenna. This technique provides isolation in addition to a wide bandwidth of operation, but cannot be readily extended to more than two transmitters without using narrow band tuned elements or sacrificing a substantial amount of transmitter output power.

In the copending U.S. Pat. application Ser. No. 601,560, referred to above, a particular solution is described which provides a vast improvement over the previously mentioned prior art systems. This copending U.S. application, which is hereby incorporated by reference into the specification of the present invention, discloses the use of a hybrid combining network for receiving a plurality of independent signal sources and producing a plurality of output signals which are each coupled to an associate independent antenna element. These antenna elements each create an independent radiation pattern and these radiation patterns combine to form single composite radiation patterns for each of the independent signal sources. However, the effectiveness of this system is decreased as additional signal sources are added to the system, since these signal sources will result in an antenna array having a very large overall dimension. In addition, the complexity of the combining network is greatly increased when more than 4 independent signal sources are to be combined.

SUMMARY OF THE INVENTION

An object of the present invention is to provide an interleaved antenna array adaptable for use in a multiple input antenna system which overcomes all of the aforementioned deficiencies.

A more particular object of the invention is to provide an improved multiple input antenna system in which a single interleaved antenna array is simultaneously used by two pluralities of radio devices while broadband electrical isolation between these devices is provided and improved radiation patterns are obtained.

Another object of the present invention is to provide a simplified and reduced size multiple input antenna system which can provide a large number of isolated independent devices with radiation patterns that do not have undesired relatively deep nulls.

In one embodiment of the present invention, an interleaved antenna array for two groups of independent transmiters/receivers is provided. The interleaved antenna array is adaptable for use in a multiple input antenna system and comprises: a first plurality of antenna elements for generating a first composite radiation pattern for at least one of a first plurality of independent electrical devices, each antenna element of the first plurality of antenna elements being disposed about a central axis for independently generating an associated radiation pattern directed substantially away from all of the antenna elements; and a second plurality of antenna elements for independently generating a second composite radiation pattern for at least one of a second plurality of independent electrical devices, each antenna element of the second plurality of antenna elements being disposed about the central axis for independently generating an associated radiation pattern directed substantially away from all of the antenna elements.

Basically the present invention comprises two pluralities of antenna elements alternately circumferentially disposed about a central axis. Each element generates an independent radiation pattern directed substantially away from the central axis and each of the other elements. One group of antenna elements forms first composite radiation patterns for a first group of electrical devices and the other interleaved group of antenna elements forms second composite radiation patterns for a second group of electrical devices. By interleaving the antenna elements and disposing them as indicated, an overall reduction in the size of the antenna array is obtained which results in improving the desired directivity of each of the composite radiation patterns. In addition, the use of every other antenna element in the array to create a composite pattern avoids the creation of deep nulls in the composite pattern caused by the combining of too many individual radiation patterns to form a single composite pattern. The interleaving also results in reducing the complexity of combining networks which couple the electrical devices to the antenna elements and create the required electrical phase shifts between the radiation patterns created by adjacent antenna elements in each group of antenna elements.

BRIEF DESCRIPTION OF THE DRAWINGS

For a more complete understanding of the present invention, reference should be made to the drawings, in which:

FIG. 1 is a horizontal cross sectional diagram of a prior art four element vertical antenna array;

FIG. 2 is a graph illustrating the horizontal radiation pattern created by each of the antenna elements in FIG. 1;

FIG. 3 is a schematic diagram of a prior art four input antenna system which uses the antenna elements shown in FIG. 1;

FIG. 4 is a diagram illustrating the electrical characteristics of a hybrid network;

FIG. 5 is a table illustrating various signal phase relationships in the antenna system show in FIG. 3;

FIG. 6 is a graph illustrating the composite horizontal radiation pattern produced by the prior art antenna system in in FIG. 3;

DESCRIPTION OF THE PREFERRED EMBODIMENT OF THE INVENTION

Figure 7:
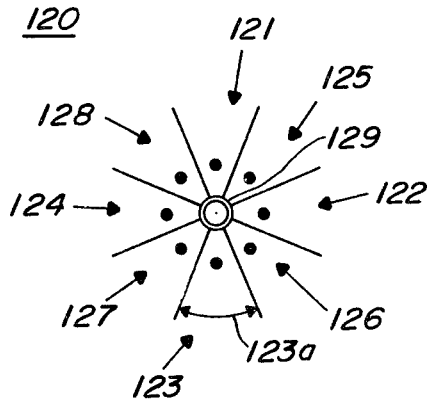
FIG. 7 is a horizontal cross sectional diagram of an interleaved eight element vertical antenna array.

FIGS. 1 through 6 illustrate the operation of a multiple input antenna system described in the previously referred to copending U.S. patent application. Since a basic understanding of this prior invention is essential to understanding the present invention, the operation of this prior art invention will now be described with reference to the FIGS. 1 through 6. Subsequently, the operation of the present invention will be described with reference to the FIGS. 7 through 9.

FIG. 1 illustrates an antenna array 20 for use at 900 MHz which comprises four corner reflector antenna elements generally indicated at 21, 22, 23 and 24. The corner reflectors are circularly disposed around a center axis 25, and each has a 90° firing aperture which faces radially outwardly. Corner reflector antennas are well known in the state of the art and basically consist of two sides of a bent reflector panel (such as $21_a$) and a center radiating rod (such as 21*b*). The center axis 25 is a four inch diameter pipe in the preferred embodiment. The outer diameter of array 20 is 1.25 feet and therefore each reflector antenna has a firing aperture (23*a*) of approximately one foot of which is approximately one wavelength at 900 MHz. Typically the reflector panels are a grid of wires rather than a solid sheet of metal and are electrically as well as mechanically mounted to the center axis pipe 25.

FIG. 2 illustrates the theoretical radiation patterns produced by each of the individual antenna elements illustrated in FIG. 1. The corresponding radiation patterns have been designated by prime notation. Each pattern consists, substantially, of a single main unidirectional lobe radially directed outward from a center point 25′ which corresponds to the center axis 25 in FIG. 1. FIG. 2 has a nonlinear radial db scale. Each of the individual radiation patterns is illustrated as having 3db down points, such as points 26 and 27 for pattern 21′, which form substantially a 90° angle with the center point 25′. Thus each radiation pattern is said to have a half power beam width of 90°. The 3db points of the adjacent radiation patterns are substantially coincident. The half power beam width of a corner reflector antenna is determined by the firing aperture dimension (e.g. 23*a*) and a one wavelength aperature creates a 90° beam width. It should be emphasized that FIG. 2 merely depicts the individual radiation patterns that are created by each of the four antenna elements acting individually and not the composite radiation pattern created by the simultaneous excitation of all four of the antenna elements.

FIG. 3 shows a four input transmitter antenna system 30 which uses the antenna elements 21 through 24 depicted in FIG. 1 and identically numbered. Independent and isolated RF (radio frequency) generators 31, 32, 33 and 34 are shown connected to first and second input ports 41 and 42 of a hybrid network 40 and first and second input ports 51 and 52 of a hybrid network 50, respectively. The first, second, third and fourth ports of a typical hybrid network, such as network 40, are designated as 41, 42, 43, and 44 respectively. Similar notation for the network ports will be used for all subsequently referred to hybrid networks. The antenna system 30 also comprises a hybrid network 60 having its third and fourth ports (63 and 64) coupled to antenna elements 21 and 22 respectively, and a hybrid network 70 having its third and fourth ports (73 and 74) coupled to antenna elements 24 and 23, respectively. Input ports 61 and 62 of hybrid network 60 are connected to ports 43 and 53, respectively, and input ports 71 and 72 of hybrid network 70 are connected to ports 44 and 54, respectively. The hybrid networks 40, 50, 60 and 70 form a combining network 80, shown dashed. Thus the antenna system 30 basically comprises a single plurality of transmitters 31–34, a plurality of antenna elements 21–24, and a combining network 80.

FIG. 4 illustrates the electrical properties of a typical hybrid network 90 having terminals 91, 92, 93 and 94. An input signal X having a phase angle of 0° is shown present at terminal 91 and results in output signals being created at terminals 93 and 94, each having half the magnitude of the input signal at terminal 91. The signal at terminal 93 is 180° out of phase with the signal at terminal 91 and the signal at terminal 94 is 90° out of phase with the signal at terminal 91. The signal present at terminal 91 creates no signal at terminal 92 and therefore this terminal is referred to as the "isolated terminal". When separate independent signals are applied to both terminals 91 and 92, isolation is maintained between these signals and an addition of composite signals is obtained at terminals 93 and 94 which are also isolated from each other. Hybrid networks, such as the one shown in FIG. 4, are commonly available and are well known in the art as 90° hybrid couplers. There also exist 180° hybrid networks in which the phases of the signals at terminals 93 and 94 differ by 180° from each other. These 180° hybrid networks also maintain broadband isolation between each of the input ports and each of the output ports.

FIG. 5 is a table which illustrates the phase relationships of each signal in FIG. 3, received by each antenna element from each transmitter when all of the hybrid networks are 90° couplers. In this table a vector pointing in a right hand direction is considered to have a phase of 0°, a vector pointing in an upward direction has a phase of 90°, a vector pointing in a left hand direction has a phase of 180°, and a vector pointing in a downward direction has a phase of 270°. Hence each signal radiated by one of the antenna elements 21–24 is 90° out of phase with the signals radiated by any adjacent antenna elemements. For example, the signals radiated by antenna element 21 will be 90° out of phase with the signals radiated by antenna elements 22 and 24. The signal actually radiated by a typical antenna element, such as element 21 for example, would be a composite signal comprising one fourth the magnitude of the signal produced by generator 31 at a phase angle of 0°, one fourth of the signal of generator 32 at an angle of 270°, one fourth of the signal of generator 33 at an angle of 270°, and one fourth the signal of generator 34 at an angle of 180°.

FIG. 6 illustrates an actual single composite radiation pattern 95 created by the circuit 30, shown in FIG. 3, when the antenna elements 21 through 24 are arranged as indicated in FIG. 1. FIG. 6 is plotted on a linear radial db scale. The composite pattern 95 is roughly omnidirectional with the largest null (95*a*) being approximately 8db down from the peak value (95*b*) of the pattern. The composite pattern is generally omnidirectional since each of the individually created patterns is 90° out of phase from each of the adjacent patterns and each pattern has its 3db points substantially coincident with the 3db points of the adjacent patterns. Signals from each of the transmitters 31 through 34 will radiate in a composite pattern similar to that shown in FIG. 6, each signal radiating in one of four composite radiation patterns which are oriented in four different horizontal directions having 90° therebetween. All four of the transmitters can simultaneously radiate signals from the same antenna elements 21–24 while isolation is maintained between all the transmitters 31–34 and all the antenna elements 21–24. Therefore a single antenna system has been provided by the prior art for simultaneously radiating a plurality of independently generated RF signals over the same antenna array.

A significant aspect of the prior art system illustrated in FIGS. 1–6 is the combining of four independent sources on a single antenna structure to create composite radiation patterns that do not have any relatively deep nulls. This prior system maintains electrical isolation between all of the independent sources by the use of hybrid couplers and the substantially outward radial direction of the radiation patterns produced by each of the antenna elements.

The prior art teaches that the way to expand the antenna system illustrated in FIGS. 1–6 to accomodate additional independent source is to create even more complex combining networks and use antenna arrays in which each additional antenna element still radiates each and every input signal. In this expanded system each antenna element generates an individual radiation pattern which has a half power beam width equal to $360°/n$, where $n$ is the total number of antenna elements. Such an expanded antenna system, while providing substantial benefits over other systems, still requires a rather large amount of space (4.5 feet in diameter for a 900 MHz eight antenna element array) and produces composite rediation patterns which have several relatively deep nulls (14db down).

The present invention expands the antenna system illustrated in FIGS. 1–6 in a totally different way which reduces the complexity of the combining network required, reduces the overall size of the antenna array and substantially eliminates the relatively deep nulls created by the prior art expansion of the antenna system.

FIG. 7 illustrates an antenna array 120 which is constructed according to the present invention for use at 900 MHz. The array comprises a first group of corner reflector antenna elements 121 through 124 and a second group of corner reflector elements 125 through 128 which are alternately circumferentially disposed about a center axis 129. Each of the antenna elements is radially directed away from the center axis 129 and each antenna element has a firing aperture dimension (123*a*) of approximately one foot, which corresponds to approximately one wavelength at 900 MHz. The overall diameter of the array 120 is 2.5 feet and the center axis 129, in one example, actually comprises a four inch pipe which is used to support the reflector panels of each of the corner reflector antennas.

Since the aperture dimension (123*a*) is approximately one wavelength, each of the reflector antennas produces a 90° half power beam width radiation pattern. The radiation patterns produced by the corner reflectors 121 and 123 are directed perpendicularly to the radiation pattern created by the antenna elements 122 and 124. Similarly, the radiation patterns created by the antenna elements 125 and 127 are perpendicularly directed with respect to the radiation patterns created by the elements 126 and 128. Thus the groups of elements 121–124 and 125–128 represent an antenna array 120 which comprises two interleaved antenna arrays which are similar to the array 20 illustrated in FIG. 1. Each of these groups of antenna elements produces a set of four individual radiation patterns similar to those shown in FIG. 2. These two sets of radiation patterns are identical to each other and differ only in that one of these sets is radially disposed 45° with respect to the other.

Figure 8:
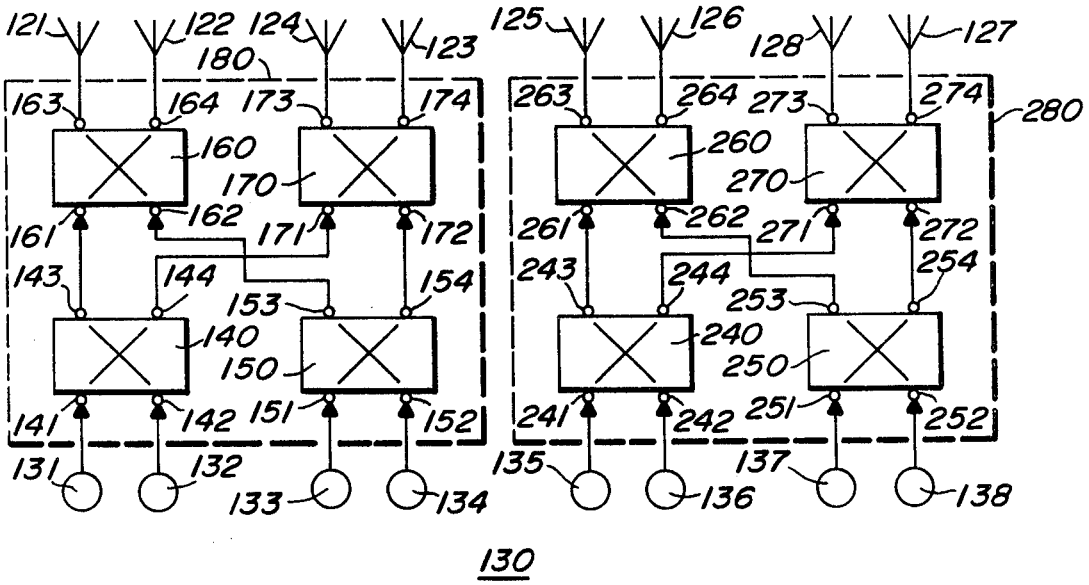
FIG. 8 is a schematic diagram of an eight input antenna system which uses the interleaved antenna elements shown in FIG. 7.

FIG. 8 illustrates an eight transmitter antenna system 130 which uses the antenna array 120 depicted in FIG. 7. The system 130 comprises four transmitters 131 through 134 coupled to the antenna elements 121 through 124 by a combining and isolating network 180, and four transmitters 135 through 138 coupled to the antenna elements 125 through 128 by a combining and isolating network 280. Four hybrid networks 140, 150, 160 and 170 are interconnected and form the network 180 (shown dashed) which is identical to the network 80 illustrated in FIG. 3.

The transmitters 131 through 134, the same antenna elements 121 through 124 and the combining network 180 form a circuit which is identical to that shown in FIG. 3, with transmitters 131–134 corresponding to transmitters 31–34, elements 121–124 corresponding to elements 21–24 and network 180 corresponding to network 80. Similarly, another identical circuit is formed with the transmitters 135 through 138 corresponding to transmitters 31–34, elements 125 through 138 corresponding to elements 21–24 and network 280 corresponding to network 80. Thus the antenna system 130 comprises two identical subsystems which are identical to the circuitry shown in FIG. 3. However, in the antenna system 130, the antenna elements of each of these subsystems are alternately disposed circumferentially about a single central axis 129. Thus isolation is maintained between all of the antenna elements while antenna elements 121 through 124 produce composite radiation patterns for the transmitters 131 through 134 and antenna elements 125 through 128 produce composite radiation patterns for the transmitters 135 through 138.

Figure 9:
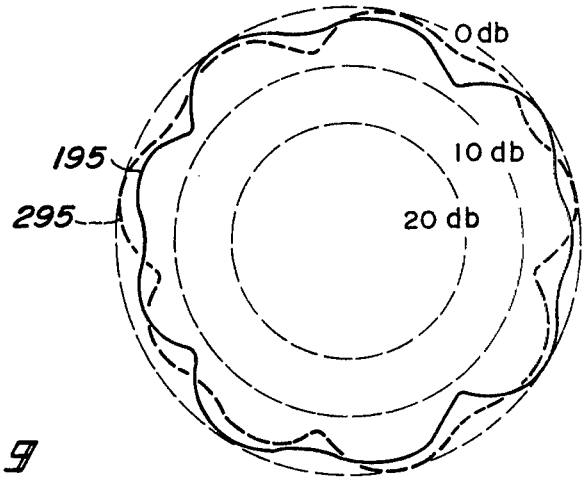
FIG. 9 is a graph of two composite horizontal radiation patterns created by the system in FIG. 8.

FIG. 9 illustrates a first composite radiation pattern 195 which is one of the representative composite radiation patterns created by the antenna elements 121 through 124. A second composite radiation pattern 295 is illustrated by dashed lines and is one of the representative composite radiation patterns produced by the elements 125 through 128. These two radiation patterns are identical to each other and differ only in that one of the patterns is rotated 45° with respect to the other. The composite radiation patterns 195 and 295 are not exactly identical to the composite radiation pattern 95 illustrated in FIG. 6 because of the larger dimensions of the antenna array 120. However, these composite radiation patterns produce a much more uniform omnidirectional radiation pattern than would be obtained if the teachings of the prior art were followed.

Thus the antenna system 130 produces a 2.5 foot diameter antenna radiating structure which produces a substantially omnidirectional pattern for eight individual transmitters while maintaining broadband isolation between each of these transmitters. The present invention provides a method for easily expanding the prior art multiple input antenna system without producing deep nulls on the composite radiation patterns, without substantially increasing the complexity of the combining networks required and without excessively increasing the size of the antenna array required.

The overall size reduction results from the fact that the present invention uses interleaved 90° half power beam width radiation patterns for each of the antenna elements, whereas the prior art uses narrower beam width radiation patterns whenever more than four radiating elements are used. This results in an increase in the antenna array size since corner reflectors must have a larger aperture dimension (123*a*) in order to produce a narrower half power beam width radiation pattern. Thus the overall dimension of the prior art system is unnecessarily increased when half power beam width radiation patterns of less than 90° are produced by the individual antenna elements.

In addition, the interleaving of four element antenna arrays reduces the complexity of the total combining network required. In the prior art expanded system, it was necessary to combine all of the transmitters so that each antenna element would radiate a signal related to each and every one of the transmitters. Additionally, the combining of eight individual radiation patterns to produce a composite radiation pattern, as done in the prior art, lead to the creation of several relatively deep nulls. This problem is eliminated in the present invention since only four radiation patterns are ever combined at one time to form a composite radiation pattern for any one signal.

While the primary application of the present invention is the creation of an omnidirectional pattern, the creation of nonsymmetrical radiation patterns is also within the scope of this invention. Additionally, this invention is not limited to the use of the inventive antenna system in conjunction with only transmitters, since receivers may be substituted for any of the transmitters used in the foregoing illustrations. Thus the inventive antenna system, by reciprocity, can be used equally effectively with both receivers and/or transmitters.

While I have shown and described specific embodiments of this invention, further modifications and improvements will occur to those skilled in the arts. All such modifications which retain the basic underlying principles disclosed and claimed herein are within the scope of this invention.

I claim:

1. An interleaved antenna array for simultaneous use by two or more groups of independent transmitter/-receivers, comprising:

a first plurality of antenna element means for generating a first composite radiation pattern for at least any one of a first plurality of independent electrical devices for processing radio frequency signals;

first coupling means for coupling each of said first plurality of devices to every one of said first pluraity antenna element means;

a second plurality of antenna element means for simultaneously and independently generating a second composite radiation pattern for at least any one of a second plurality of independent electrical devices for processing radio frequency signals, said first and second pluralities of said antenna element means being independently operative; and second coupling means, totally independent from said first coupling means, for coupling each of said second plurality of devices to every one of said second plurality antenna element means;

each antenna element means of said first plurality of antenna element means being disposed about a central axis and constructed for independently generating an associated radiation pattern directed substantially away from said central axis and each of said antenna element means of said second plurality of antenna element means; and each antenna element means of said second plurality of antenna element means being alternately disposed circumferentially about said central axis with each of said first plurality antenna element means, and each of said second plurality antenna element means constructed for independently generating an associated radiation pattern directed substantially away from said central axis and each of said antenna element means of said first plurality of antenna element means, and wherein said first coupling means includes first circuitry for providing a 90° electrical phase shift between the associated radiation patterns created by adjacent antenna element means in said first plurality of antenna element means and said second coupling means includes second circuitry for providing a 90° electrical phase shift between the associated radiation patterns created by adjacent antenna element means in said second plurality of antenna element means.

2. An interleaved antenna array according to claim 1 wherein each of said antenna element means is constructed for creating radiation patterns having substantially a 90° power beam width.

3. An interleaved antenna array according to claim 2 wherein each of said antenna element means is a corner reflector antenna.

4. An interleaved antenna array according to claim 3 wherein there are four antenna elements in each of said first and second pluralities of antenna element means.

5. An interleaved antenna array according to claim 1 wherein said associated radiation pattern generated by each said antenna element means substantially comprises a single main directional lobe directed away from all other antenna element means and the central axis.

6. An improved multiple transmitter antenna system comprising:

first and second pluralities of electrical sources, each source generating an independent input signal to be radiated;

first and second independently operative combining means coupled to said first and second pluralities of sources, respectively;

each of said first and second combining means receiving each of said input signals from said first and second pluralities of sources, respectively, maintaining isolation between said received input signals, and producing a number of first and second isolated output signals, respectively, equal in number to at least the number of said first and second input signals, respectively, each one of said first and second output signals being related to each and every one of said input signals received by said first and second combining means, respectively; and an antenna array coupled to said first and second combining network means, said array comprising pluralities of first and second antenna element means, each of said first and second antenna element means receiving and simultaneously radiating one of said first and second output signals, respectively, in a substantially independent associated radiation pattern;

said first and second antenna element means being alternately disposed about a central axis and independently and simultaneously providing, respectively, first and second composite radiation patterns for said first and second pluralities of electrical sources, and wherein each of said first and second antenna element means is disposed circumferentially about said central axis, each element means producing an individual radiation pattern which is directed away from said central axis and directed substantially away from all other of said first and second antenna element means; and also wherein said first and second combining network means each include circuitry for producing a 90° phase shift between the radiation patterns produced by adjacent first antenna element means and adjacent second antenna element means, respectively.

7. An improved multiple transmitter antenna system according to claim 6 wherein each of said antenna element means is constructed for producing radiation patterns having substantially a 90° half power beam width.

8. An improved multiple input antenna system, comprising:

first and second pluralities of independent isolated electrical devices, each device constructed for processing different frequency radio frequency signals;

first and second groups of four isolated antenna element means, the antenna element means of said first and second groups being alternately circumferentially disposed in a predetermined manner about an axis and each antenna element means constructed for generating an associated independent directional radiation pattern directed away from all other antenna element means; and first and second combining network means simultaneously coupled to each of the antenna element means of said first and second groups and simultaneously coupled to each of the electrical devices of said first and second pluralities of electrical devices, respectively, for independently and simultaneously coupling each device of said first and second pluralities of devices to each and every antenna element means of said first and second groups of antenna element means, respectively, while maintaining isolation between all of said antenna element means and all of said electrical devices;

said first and second network means creating a predetermined phase difference between radiation patterns produced by adjacent antenna elements in said first and second groups, respectively, such that said patterns combine to form first and second desired, composite, omnidirectional radiation patterns for each of said independent devices in said first and second pluralities of electrical devices, respectively.

9. An improved multiple input antenna system according to claim 8 wherein the predetermined phase difference is substantially 90°.

10. An improved multiple input antenna system, comprising:

first and second pluralities of independent isolated electrical devices, each device constructed for processing different frequency radio frequency signals;

first and second pluralities of isolated antenna element means, the antenna element means of said first and second pluralities being alternately disposed in a circumferential manner about an axis and each antenna element means constructed for generating an associated independent directional radiation pattern directed away from all other antenna element means; and first and second combining network means simultaneously coupled to each of the antenna elements means of said first and second pluralities of antenna element means and simultaneously coupled to each of the electrical devices of said first and second pluralities of electrical devices, respectively, for independently and simultaneously coupling each device of said first and second pluralities of devices to each and every antenna element means of said first and second pluralities of antenna element means, respectively, while maintaining isolation between all of said antenna element means and all of said electrical devices;

said first and second network means creating a predetermined phase difference between radiation patterns produced by adjacent antenna element means in said first and second pluralities, respectively, such that said radiation patterns produced by said first plurality of antenna element means combine to form a first desired composite radiation pattern substantially identical in shape and direction for each of said first plurality of independent devices, and said radiation patterns produced by said second plurality of antenna element means combine to form a second desired composite radiation pattern identical in shape and direction for each of said second plurality of independent devices.

11. An improved multiple input antenna system according to claim 10 wherein said first and second composite radiations are substantially identical in shape and direction to each other.

* * * * *

UNITED STATES PATENT AND TRADEMARK OFFICE

CERTIFICATE OF CORRECTION

PATENT NO. : 4,101,901
DATED : July 18, 1978
INVENTOR(S) : Richard S. Kommrusch

It is certified that error appears in the above-identified patent and that said Letters Patent are hereby corrected as shown below:

In line 3 of claim 11, please delete the word "radiations" and insert -- radiation patterns --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*